United States Patent [19]

Gaskin

[11] 3,982,646

[45] Sept. 28, 1976

[54] REACH TRUCKS

[75] Inventor: Graham Edward Gaskin, Ipswich, England

[73] Assignee: Ransomes Sims & Jefferies Limited, Suffolk, England

[22] Filed: Aug. 14, 1975

[21] Appl. No.: 604,813

Related U.S. Application Data

[63] Continuation of Ser. No. 400,545, Sept. 25, 1973, abandoned.

[30] Foreign Application Priority Data

Oct. 3, 1972 United Kingdom ..... 45568/72

[52] U.S. Cl. ..... 214/670

[51] Int. Cl.[2] ..... B66F 9/10

[58] Field of Search ..... 214/660, 670, 671, 672, 214/673, 674, 510; 74/110

[56] References Cited

UNITED STATES PATENTS

| | | | |
|---|---|---|---|
| 2,496,079 | 1/1950 | Wessman | 214/510 |
| 3,151,755 | 10/1964 | Quayle | 214/670 |
| 3,536,221 | 10/1970 | Goodacre | 214/670 |

*Primary Examiner*—L. J. Paperner
*Assistant Examiner*—Lawrence J. Oresky
*Attorney, Agent, or Firm*—Browdy and Neimark

[57] ABSTRACT

In a reach truck there is provided a frame including a pair of parallel guides, a mast supported on and movable along the guides and mechanism for extending and retracting the mast along the guides, said mechanism comprising a lever depending from and rotatable about a horizontally disposed pivotal axis fixed relatively to and located on an upper part of the frame, means for rotating the lever about its pivotal axis, and, a link pivotally connected with the mast and with the lever at a substantial distance from the horizontally disposed pivotal axis thereof and on the side of said pivotal axis remote from the mast so that, on rotation of the lever, the link applies a force to the mast having a substantial component in the horizontal direction.

4 Claims, 3 Drawing Figures

REACH TRUCKS

This is a continuation of application Ser. No. 400,545, filed Sept. 25, 1973, now abandoned.

This invention relates to reach trucks. Because of space limitations on reach trucks, it is desirable to provide the mechanism for extending and retracting the mast of the truck in as compact a form as possible.

The present invention consists in a reach truck having a frame including a pair of parallel guides, a mast supported on and movable along the guides and mechanism for extending and retracting the mast along the guides, said mechanism comprising a lever depending from and rotatable about a horizontally disposed pivotal axis fixed relatively to and located on an upper part of the frame, means for rotating the lever about its pivotal axis, and, a link pivotally connected with the mast and with the lever at a substantial distance from the horizontally disposed pivotal axis thereof and on the side of said pivotal axis remote from the mast so that, on rotation of the lever, the link applies a force to the mast having a substantial component in the horizontal direction.

Suitably, the link is downwardly inclined through a small angle from its pivotal connection with the lever towards the mast.

Advantageously, the lever is cranked and includes an upright part depending from the horizontal pivotal axis of the lever and a part extending from the upright part at a location remote from the pivotal axis of the lever in the direction away from the mast.

Preferably, the means for locating the lever comprise an upright hydraulic ram having relatively movable elements, one of which is pivotally connected with the frame of the truck whilst the other is pivotally connected with an arm which is pivotable about the horizontal axis of the lever and fixed relatively to the lever.

The invention will now be described, by way of example, with reference to the accompanying drawings, in which.

Figure 1:
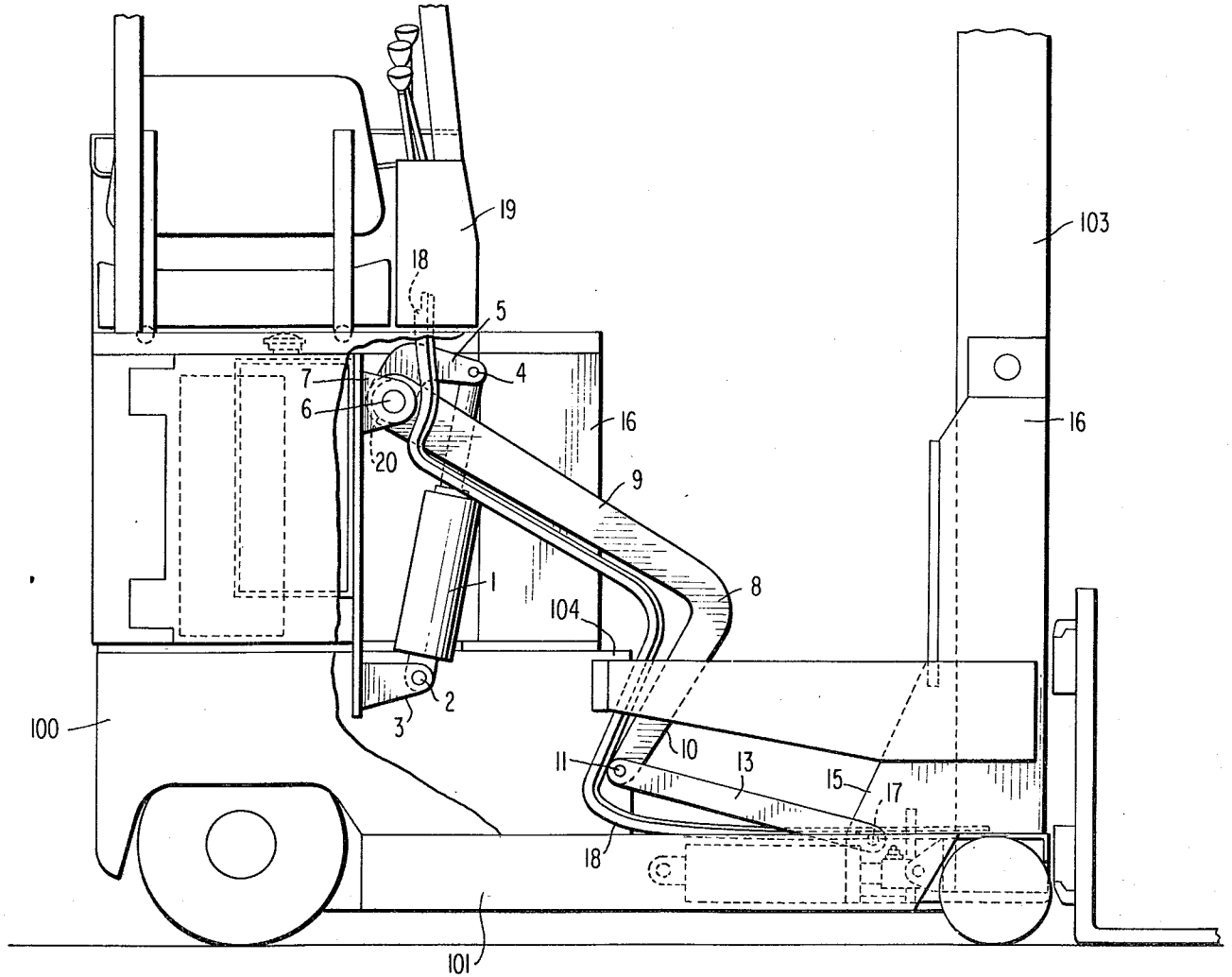
FIG. 1 is a partially cutaway front elevation of a reach truck showing the mast of the truck in its extended position, and, FIG. 2 is a further elevation of the truck as seen looking from left to right of FIG. 1.
Figure 2:
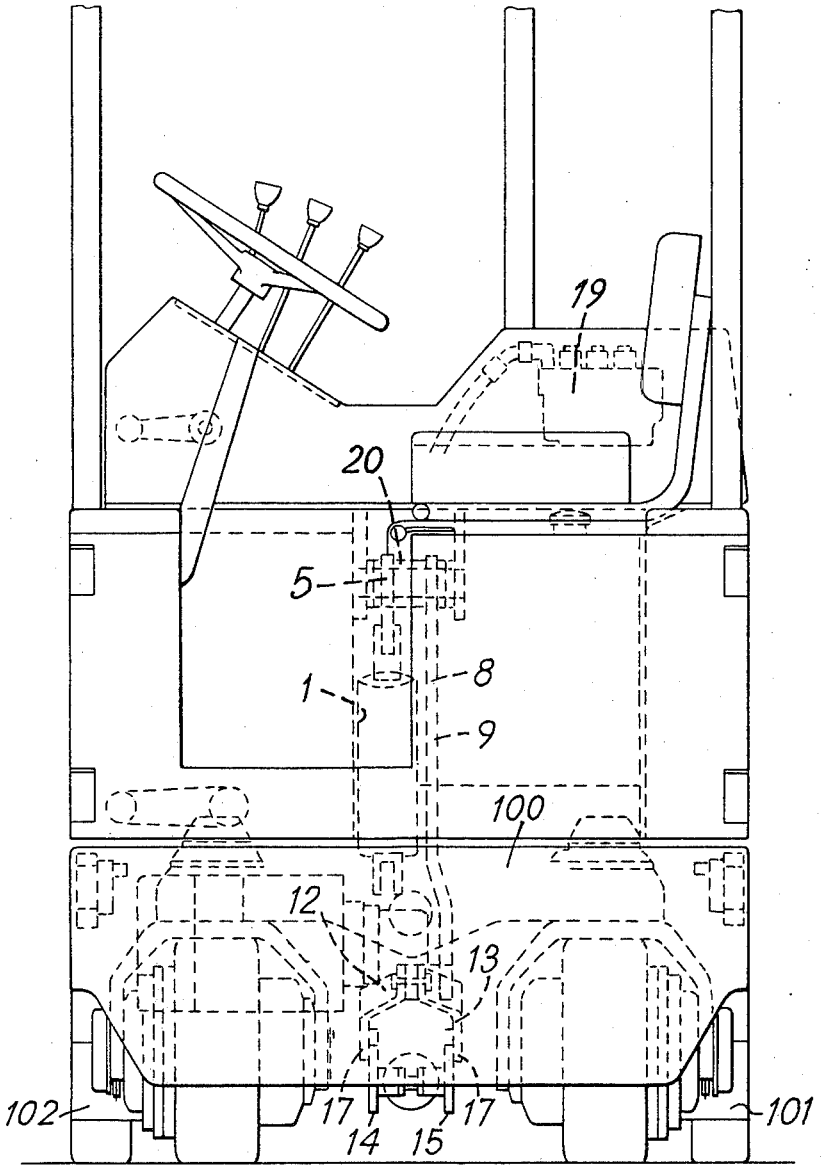

The reach truck illustrated in FIGS. 1 and 2 includes a main frame 100 having parallel guides 101 and 102 along which a mast 103 is movable, the mast supporting a carriage 104 which is vertically movable along the mast. Mechanism for extending and retracting the mast includes a hydraulic cylinder 1 of comparatively short stroke which is mounted in a near vertical position on the frame of the vehicle. The lower end of the cylinder 1 is pivotally connected by a pin 2 to fixed brackets 3 on the vehicle frame. The upper or rod end of the cylinder is pivotally connected by a pin 4 to a bell crank arm 5 which is rotatably mounted on a horizontal axis about a pin 6 which in turn is retained in fixed brackets 7 comprising part of the vehicle frame. The arm 5 is rotated about its axis by extending and retracting the cylinder 1.

The arm 5 is fixed in a prescribed angular relationship to a lever 8 by a connecting tube 20 through which passes the pivot pin 6 about which the lever 8 rotates in fixed angular relationship to the arm 5. The lever 8 pendently carried on the tube 20 comprises an upper portion 9 which when the mast is in its fully retracted position is substantially vertical and a shorter part 10 at right angles to the portion 9 and to the axis of rotation about the pin 6. The part 10 extends in a direction substantially parallel with the direction of a portion of the arm 5.

The end of the part 10 of the lever 8 is pivotally connected by a pin 11 to one end of two parallel links 12 and 13. The two links 12 and 13 are mounted on opposite sides of the part 10 of the lever 8 and are shaped such that they straddle part of the "mast tilting mechanism" and connect to the two spur brackets 14 and 15 which are fixed on the mast 103 at the lower end thereof. The links 12 and 13 are pivotally connected to the brackets 14 and 15 by two pins 17.

It will be noted that the links 12 and 13 are slightly downwardly inclined from the pin 11 to the pins 17. Accordingly, upon extension or retraction of the cylinder 1 the force exerted through the links 12 and 13 on the mast has a substantial component in the horizontal direction which facilitates movement of the mast along the parallel guides 101, 102.

Because of the substantial distance between the pins 6 and 11, the movement of the mast 103 effected by movement of the lever 8 and links 12 and 13 is a substantial multiple, of the order of 5:1, of the, as the case may be, extension or retraction movement of the cylinder 1.

Figure 3:
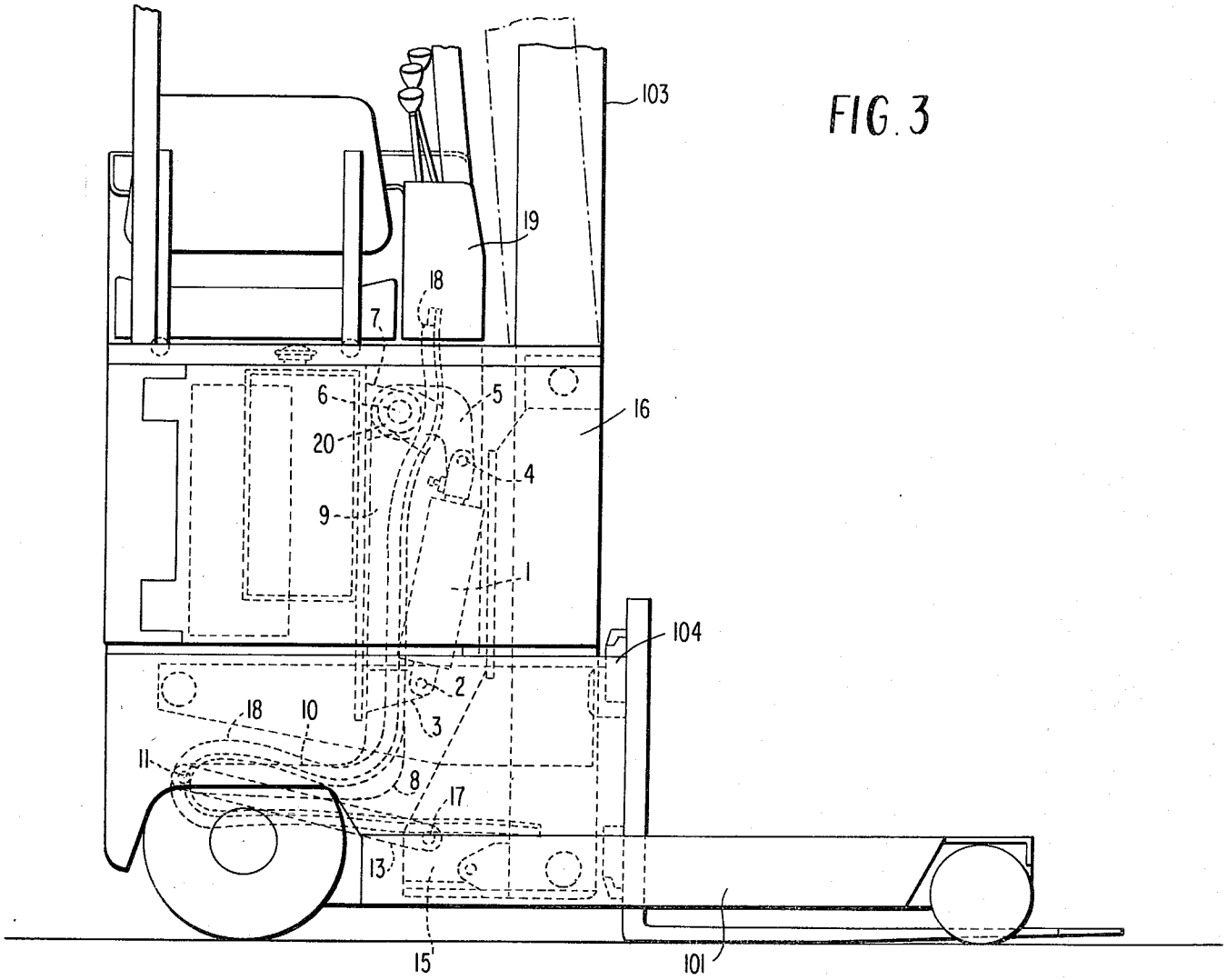
FIG. 3 is a front elevational view of the reach truck of the present invention with the mast in fully retracted position.

FIG. 3 shows the view of the reach truck of the present invention with the mast 103 in the fully retracted position, the same reference numerals used with respect to FIG. 1 are used to identify identical elements shown in FIG. 3.

The cranked shape of the lever 8 is particularly convenient inasmuch as in the fully retracted position of the mast 103, the lever 8 is disposed with its portion 9 hanging vertically alongside the driver's compartment and its portion 10 extending substantially horizontally below that compartment. The shape of the lever 8 is also advantageous inasmuch as it facilitates the disposition of links 12 and 13 at a shallow downward inclination from the pin 11 to the pins 17.

The mast extension and retraction mechanism described above also serves to guide and carry the flexible hydraulic hoses 18 from a hydraulic valve 19 which is mounted on the vehicle frame above the pivot bracket 7. The hoses emerge from beneath the valve assembly, pass by the pivot tube 20 and are secured at prescribed intervals along the length of the lever 8. Approximately half way along the part 10 of the lever 8 the hoses are left free to follow a generous bend around the pivot point 11 to pass beneath it and then to be secured at a prescribed point to the links 12 and 13. From this point the hoses are routed to their respective connections on the various cylinders in the mast and carriage assembly.

I claim:

1. A reach truck comprising:

a frame;

a pair of parallel guides forming a lower part of said frame and mutually spaced transversely of the truck, said guides defining a first plane;

a mast supported on and reciprocably movable along said guides; and mechanism for moving said mast along said guides between an extended and a retracted position, said mechanism including a cranked lever having a first, upright part pendantly mounted on an upper part of said frame and alongside the front thereof for rotation about a pivotal axis parallel with said first plane, and a second part extending from said first part at a location remote from said pivotal axis of said lever in the direction away from said mast, means for rotating said lever about its pivotal axis, and a link having a first pivotal connection with said mast in the vicinity of said first plane and a second pivotal connection with said second part of said lever, said second pivotal connection being in the retracted position of said mast located on the side remote from said mast of a second plane normal to said first plane and containing both said first part of said lever and said pivotal axis of said lever, the attitude of said link relative to said first plane ensuring that throughout the entire movement of said mast on extension or retraction thereof the force transmitted through said link has a major component parallel with said guides.

2. A truck as claimed in claim 1, wherein said means for rotating the lever comprise an upright hydraulic ram having relatively movable elements, one of which is pivotally connected with the frame of the truck whilst the other is pivotally connected with an arm which is pivotable about said pivotal axis of the lever and fixed relatively to the lever.

3. A reach truck comprising:

a frame;

a pair of parallel guides forming a lower part of the frame and mutually spaced transversely of the truck, the guides defining a first plane;

a mast supported on and reciprocably movable along the guides; and mechanism for moving the mast along the guides between an extended and a retracted position, said mechanism including a lever pendantly mounted on an upper part of the frame for rotation about a pivotal axis parallel with the said first plane, means for rotating the lever about its pivotal axis, and a link having a first pivotal connection with the mast in the vicinity of said first plane and a second pivotal connection with the lever at a location on the lever remote from its pivotal axis, the second pivotal connection being in the retracted position of the mast located on the side remote from the mast of a second plane normal to the first plane and containing said pivotal axis of the lever, the attitude of the link relative to the first plane ensuring that during the entire movement of the mast on extension or retraction thereof the force transmitted through the link has a major component parallel with the guides.

4. A reach truck comprising:

a frame;

a pair of parallel guides forming a lower part of said frame and mutually spaced transversely of the truck, said guides defining a first plane;

a mast supported on and reciprocably movable along said guides; and mechanism for moving said mast along said guides between an extended and a retracted position, said mechanism including a cranked lever having a first, upright part pendantly mounted on an upper part of said frame for rotation about a pivotal axis parallel with said first plane and a second part extending from said first part at a location remote from said pivotal axis of said lever in the direction away from said mast, means for rotating said lever about its pivotal axis, and a link having a first pivotal connection with said mast in the vicinity of said first plane and a second pivotal connection with said second part of said lever, said second pivotal connection being in the retracted position of said mast located on the side remote from said mast of a second plane normal to said first plane and containing said pivotal axis of said lever, the attitude of said link relative to said first plane ensuring that throughout the entire movement of said mast on extension or retraction thereof the force transmitted through said link has a major component parallel with said guides.

* * * * *